United States Patent [19]

Larson et al.

[11] 4,222,611

[45] Sep. 16, 1980

[54] IN-SITU LEACH MINING METHOD USING BRANCHED SINGLE WELL FOR INPUT AND OUTPUT

[75] Inventors: William C. Larson; Roger J. Morrell, both of Bloomington, Minn.

[73] Assignee: United States of America as represented by the Secretary of the Interior, Washington, D.C.

[21] Appl. No.: 66,998

[22] Filed: Aug. 16, 1979

[51] Int. Cl.[3] ..... E21B 43/28

[52] U.S. Cl. ..... 299/4; 299/5; 166/268

[58] Field of Search ..... 299/2, 4, 5; 166/268–272; 175/61

[56] References Cited

U.S. PATENT DOCUMENTS

| | | | |
|---|---|---|---|
| 2,404,341 | 7/1946 | Zublin | 175/61 X |
| 3,587,743 | 6/1971 | Howard | 175/61 X |
| 4,022,279 | 5/1977 | Driver | 166/271 |

*Primary Examiner*—Ernest R. Purser

*Attorney, Agent, or Firm*—Thomas Zack; Donald A. Gardiner

[57] ABSTRACT

A method and apparatus for in-situ leach mining which utilizes multiple downhole branch wells whipstocked off a single main generally vertical well. Initially the vertical well is drilled into the earth so that it may intersect the ore zone of material to be recovered. The vertical well may be cased and cemented after drilling. Thereafter from this same well a plurality of branch wells are whipstocked or drilled which intersect the vertical well at an angle from about 2 degrees to 60 degrees. These branch wells extend into the ore zone. A submersible pump and drop pipe are placed in the main well and at some point below the intersection of the main well with the branch wells a packer is placed around the drop pipe. The drop pipe carries solutions to the surface from the pump. Leaching solutions are forced or injected in the main well in the volume between the exterior surface of the drop pipe and well hole or casing so that upon encountering the branch wells and packer their solutions are forced into the branches and out into the ore body. After exiting near the opened ends (or well screens) of the branch wells into the ore zone, the leaching solution dissolves the mineral values and the solution flow with its entrapped minerals is forced by the action of the pump through the ore zone towards the vertical well, where the solution is pumped up to the surface, via the inner drop pipe.

2 Claims, 1 Drawing Figure

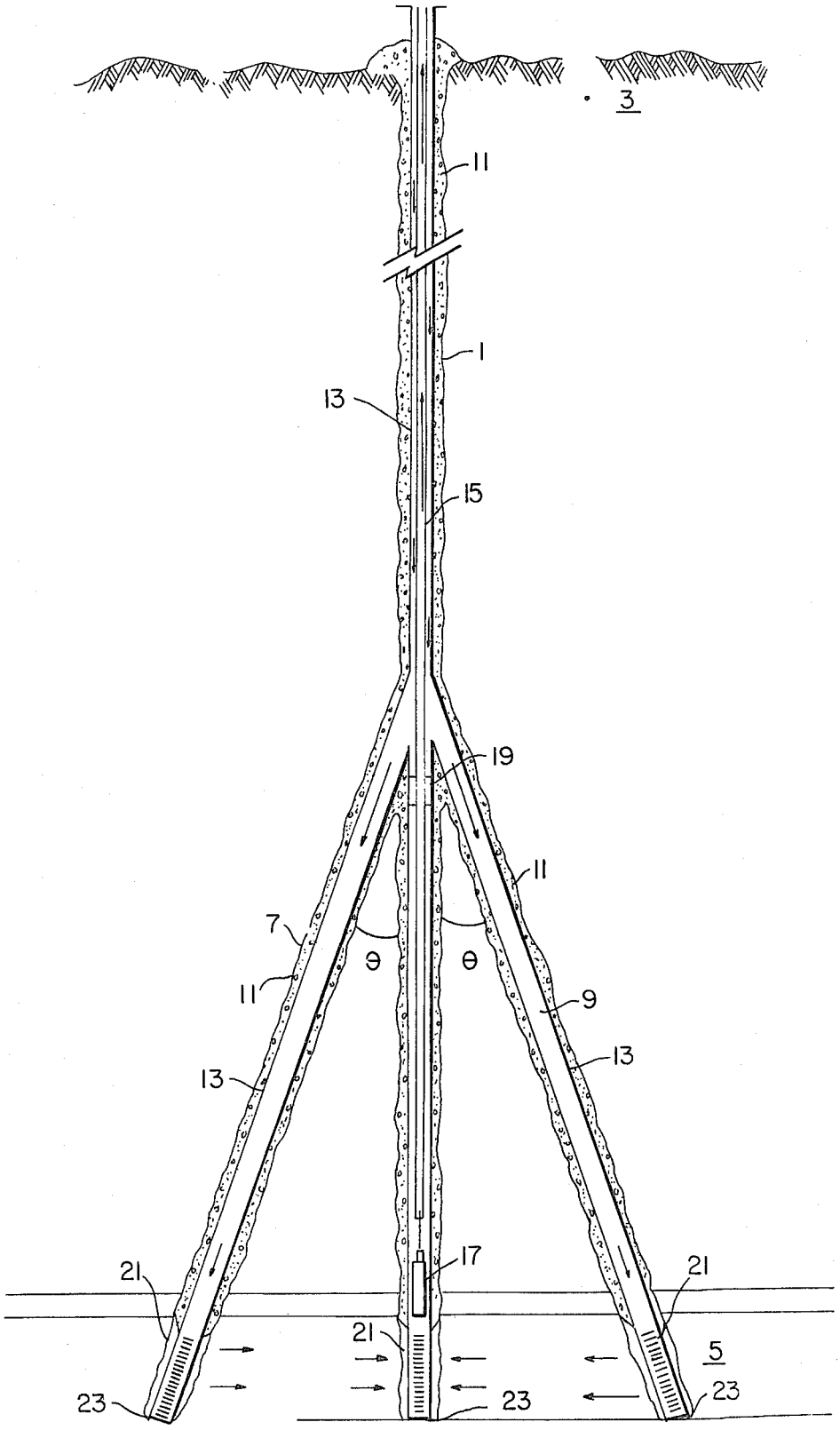
3
11
1
13
15
19
11
7
θ
θ
11
9
13
13
17
21
21
21
5
23
23
23

IN-SITU LEACH MINING METHOD USING BRANCHED SINGLE WELL FOR INPUT AND OUTPUT

BACKGROUND OF THE INVENTION

1 Field of the Invention

The invention described herein relates to a method of mining which employs leach solutions to recover materials by using a single injection/recovery well.

2 Description of the Prior Art

The current basic practice in situ leach mining field which utilizes injection solutions requires the drilling of a separate hole for each of several wells. Most of these wells are usually injection wells and one or more are recovery wells. Normally these holes are drilled to depths greater than 300 feet and then each cemented and cased to the surface. For the typical inverted 5-spot or 7-spot pattern used in situ leach mining, one recovery well is surrounded by four or six, as the case may be, injection wells. Other patterns of injection/recovery wells are possible such as those described in the commonly assigned copending U.S. patent application bearing Ser. No. 60101 filed July 24, 1979, and entitled "Method of In Situ Mining," or those described in Bureau of Mines Information Circular (IC)-8777, titled "Uranium in Situ Leach Mining in the United States."

With these prior art practices there is considerable time and expense involved in the drilling, moving, and setting up of the drill rig and other associated equipment for drilling each well hole. In addition, when deep holes (more than 1,000 feet) are drilled vertical deviations become a serious problem particularly where the injection and recovery wells are less than 50 feet apart. Not only are the above problems greatly reduced or practically eliminated by using a single injection/recovery well, as we propose herein, the total footage of drilled material would be considerably less than the present state of the art 5 spot pattern since all of the separate injection wells are eliminated.

None of the known patent or other prior art is concerned with multiple completions for in situ leach mining. U.S. Pat. No. 2,171,416 (R. E. Lee) is concerned with a method of drilling wells by using angular (approximately 90 degrees) drilling at the bottom of the hole to enlarge the productive area of the well. Within these branch channels acid, other chemicals or explosive charges are used to stimulate oil and gas production by introducing them thereto. A pump may be used (column 2, lines 30–38) to introduce the acid or other chemical into the central tube placed in the main vertical drill hole. Nothing is said about using leaching solutions in an injection/recovery type of well to obtain underground minerals from an ore zone.

Other United States patents of interest include U.S. Pat. Nos. 3,223,158 (Baker), 3,941,422 (Henderson), 3,978,926 (Allen), and 4,022,279 (Driver). None are believed any more relevant than the mentioned R. E. Lee patent nor do they relate to mining using leaching solutions that employ a single injection/recovery well.

SUMMARY OF THE INVENTION

Our invention is a method with its associated apparatus of in situ leach mining in which a single well head is used to inject the leaching solution and also to recover the minerals contained in the recoverable leaching solution. The well head has a main generally vertical well and a plurality of interacting branch wells that are drilled to extend outwardly therefrom at an angle of say 2 to 60 degrees to the main well. Extending down the main well is a central conduit which receives the recoverable leaching solution and minerals. A submersible pump at the lower end of the conduit may be placed within the conduit near the mineral ore zone. A packer is placed between the pump and the branch wells around and outside of the main conduit to prevent the flow of solution pass it. The outer ends of each of the branch wells extend into the ore zone and provide for the injection of the leaching solution thereto from the surface down the main well outside of its conduit. After the solution has been forced into the ore zone, a negative pressure is built up by the pump to cause the recoverable solution and minerals to be forced to the vertical well, and finally the solution is pumped to the surface via the conduit (drop pipe).

The primary object of our invention is an improved method of leach mining.

BRIEF DESCRIPTION OF THE DRAWINGS

The FIGURE schematically illustrates in cross-section how the preferred embodiment of the invention would operate.

DESCRIPTION OF THE PREFERRED EMBODIMENT

The basic set up for the preferred embodiment is illustrated in the drawings. Initially a main drill hole 1 is drilled into the earth in a generally vertical direction down from the surface 3. Since we are herein concerned with leach mining this main drill hole could easily be 1,000 feet or more. It would normally extend into the ore zone 5 of mineral sought to be recovered by a leaching solution mining method. At some point above the ore zone, through the main first hole, an angle ($\theta$) branch hole 7 (or holes 7 and 9) is then drilled or whipstocked to intersect the ore zone near its lowest end. Depending on the location of the ore zone and the desired operating parameters, the angle $\theta$ between the main vertical drill hole and the downwardly and outwardly extending branch hole would typically be in the range of 2 to 60 degrees from the vertical. And the branch drill hole segment would normally extend 25 to 200 feet from its intersection with the main well depending, of course, on the location of the ore zone. The lower end of each branch hole is so constructed that leaching solution injected from the surface, at about 100 psi., will exit therefrom into the ore zone. As is conventional in the drilling art each of the holes (three shown) are each cemented 11 and cased 13 to the surface. A slotted screen 21 or pipe with a cap for the well's end may be utilized near the ends of the branch wells and the main well to allow the solution to exit.

After the main drill hole and the branch hole (or holes) are drilled to complete the well head, a hollow drop pipe 15 with an electrically operated submersible pump 17 at its lower end are placed in the main vertical drill hole so that the pump extends near or into the ore zone. Within the main drill hole below the intersection of the branch wells a packer 19 is placed around the hollow drop pipe to act as a barrier to prevent the flow of leaching solution with or without mineral in it from moving past that point from below or above, respectively.

Several of the components disclosed in the drawings are conventional off the shelve items in common usage.

These would include the drop pipe, casing, cement for the casing, pump, packer, and the screened or slotted capped end for each well. Further, explanation as to their exact embodiment is believed unnecessary as their composition and function(s) are well known to those skilled in the leach mining art. A good example of the type of components that could be used can be found in the Bureau of Mines IC-8777 titled Uranium In Situ Leach Mining in the U.S., by W. C. Larson 1978. The operation is self-evident. The particular leaching solution selected for the particular mineral sought to be recovered is injected down the main hole from the surface. This is done in the annular volume located between the exterior surface of the drop pipe and the well casing. Pressure ranges from 0 to 100 psi. would normally be employed so that the solution moves in the direction of the arrows as shown in the drawings. Upon exiting from the screened or slotted sections near the ends of the branch wells, the solution would permeate the ore zone. Concurrent or shortly after the injection step takes place, the electric pump 17 is made operative to cause a negative pressure zone to develop around the end of the main drill hole. This pressure differential causes solution with minerals to move from the branch wells towards the slotted screen and pump and to the pipe. Eventually it moves up the inside of the drop pipe to the surface in the direction of the arrows. Thereafter further conventional processing is employed to extract the uranium, copper, gold, silver or other minerals from the recoverable solution depending on the type of mineral(s) being leached.

It is important to note that our invention is specifically adopted for use with leach mining and the various patterns of injection/recovery wells commonly being used. These would include the five spot pattern, the seven spot pattern, the Utah Construction and Mining Co. pattern, the Ore body configuration pattern, the Multiple five-spot and the Multiple seven-spot pattern. The United States Bureau of Mines Information Circular (IC) 8777, dated in 1978, on page 68 authored by co-inventor William C. Larson entitled "Uranium In Situ Leach Mining in the United States" illustrates these common injection-recovery well patterns. Our single injection/recovery well heretofore disclosed can be used in these same field patterns to provide for the injection and recovering of leach solutions at each well. This would allow the same ore body well patterns used by industry to be retained. Commonly each of our wells would have a spacing between themselves of 15–200 feet that would include both the main vertical well and the branch wells.

Drilling or whipstocking the branch well at the angle from the main drill hole may be accomplished by using the well known down-hole deviation and/or conventional whipstock drilling techniques. These type of drilled angled branch wells are per se well known and by themselves do not consitute novelty. However, the prior art is silent as to this type of drilling technique as applied to leaching solutions. Further the prior art does not disclose these techniques being employed in a single injection/recovery leaching solution mining well.

One of the most important benefits or our invention over the prior art is the reduction of materials and related costs to accomplish the same objectives as the present state-of-the art techniques. For example, assuming a typical 5-spot pattern is used employing four injection wells placed on four corners of a square with the center well (of the square) being the single recovery well. If each well were 2,00 feet deep then the total footage drilled for this mine leaching solution pattern would be 10,000 feet at a cost of X dollars per foot times 10,000 feet at a cost of X dollars per foot times 10,000 or $10,000 X. With our present invention we propose one well (the counterpart to the center well) would be drilled to a total depth of 2,000 feet. Four angled holes would then be drilled therefrom at about 250 feet each through the ore zone making a total branch footage of 1,000 feet or 3,000 feet for the total well head. This would be 7,000 feet less of drilling than the 5 spot pattern and a cost saving of about $7,000 X for drilling. Some of these apparent drilling cost savings would be lost due to the more sophisticated drilling equipment required, nevertherless, the savings would be very real and substantial.

It would be apparent that our invention allows deep leaching wells to be effective and more closely spaced together than the prior art. Thus it would find particular application to those situations where closely spaced bore holes are required (Low Permeability Rocks). Also it could be used for a variety of mineral commodities in for example small isolated ore bodies. Besides the mentioned mining uses, our invention could also be used for methane drainage where the requirement is to maximize the amount of drill hole in the coal seams itself. Placing 4 or 5 holes in the coal seam would greatly improve the drainage of methane gas with only a small increase in drilling costs.

Depending on the type of minerals sought to be recovered and the compositions of the ore zone, many different types of leaching solutions may be used. Typically for uranium these solutions are made weak acids or alkali solutions made up of 0.5 to 5 grams of an additive, such a acid or alkali, per liter of water. However, many types of leach solution can be used and as such is not a limitation of the proposed invention. Normally about 30–2000 parts per million of recoverable minerals are in the solution pumped to the surface. The method disclosed herein is contemplated as being practiced continuously, once started, until the concentration of the recoverable minerals in the leaching solution falls below some preestablished level. Other variations are, of course, possible. None should be used to limit the scope and extent of our invention which is to be measured only be the claims which follow.

We claim:

1. An in situ leaching mining method employing a combined injection/recovery well for obtaining materials from an ore zone comprising the steps of:

(1) drilling a generally vertical main injection and recovery well so that it is in communication with the ore zone of recoverable minerals;

(2) drilling at least one outwardly extending branch well from said main well at an angle between 2 to 60 degrees from the vertical, the lower ends of said at least one branch well being in fluid communication with and extending into the recoverable ore zone;

(3) inserting a conduit having a lower pump unit into the main well, said pump being capable of recovering a leaching solution that passes through the ore zone and forcing it to the surface;

(4) blocking off the volume between the conduit and the main well below where the at least one branch well intersects it; and (5) injecting a leaching solution down into said vertical well outside of its conduit to force solution to and through said at least one branch well to the ore zone whereby the pump will cause at least part of the solution with its recoverable minerals to be moved to the surface.

2. The method of claim 1 whereby drilling step (1) is at least 300 feet and drilling step (2) at least 25 feet.

* * * * *